US010689848B2

(12) United States Patent
Castel

(10) Patent No.: US 10,689,848 B2
(45) Date of Patent: Jun. 23, 2020

(54) DEVICE FOR COLLECTING RAINWATER IN A PERGOLA WITH ADJUSTABLE SLATS

(71) Applicant: Jean-Louis Castel, Poitiers (FR)

(72) Inventor: Jean-Louis Castel, Poitiers (FR)

( * ) Notice: Subject to any disclaimer, the term of this patent is extended or adjusted under 35 U.S.C. 154(b) by 0 days.

(21) Appl. No.: 15/771,190

(22) PCT Filed: Oct. 25, 2016

(86) PCT No.: PCT/FR2016/052769
§ 371 (c)(1),
(2) Date: Apr. 26, 2018

(87) PCT Pub. No.: WO2017/072438
PCT Pub. Date: May 4, 2017

(65) Prior Publication Data

US 2018/0320374 A1 Nov. 8, 2018

(30) Foreign Application Priority Data

Oct. 26, 2015 (FR) ..... 15 60199

(51) Int. Cl.

| | |
|---|---|
| ***E04F 10/10*** | (2006.01) |
| ***E04B 7/16*** | (2006.01) |
| ***E04F 10/08*** | (2006.01) |
| ***E03B 3/03*** | (2006.01) |
| *E04D 13/04* | (2006.01) |

(52) U.S. Cl.
CPC ..... *E04B 7/163* (2013.01); *E03B 3/03* (2013.01); *E04F 10/08* (2013.01); *E04D 13/0404* (2013.01)

(58) Field of Classification Search
None
See application file for complete search history.

(56) References Cited

U.S. PATENT DOCUMENTS

| | | | | |
|---|---|---|---|---|
| 3,591,980 | A * | 7/1971 | Cheng | E06B 7/084 49/403 |
| 4,671,023 | A * | 6/1987 | Gigli | E04F 10/10 52/1 |
| 2011/0162808 | A1* | 7/2011 | Castel | E04B 7/163 160/174 R |
| 2017/0226746 | A1* | 8/2017 | Byszenski | E05F 15/619 |

FOREIGN PATENT DOCUMENTS

| | | | |
|---|---|---|---|
| AU | 412 687 | B2 | 4/1971 |
| EP | 2 589 720 | A1 | 5/2013 |
| FR | 2 676 079 | A1 | 11/1992 |
| WO | 2014/136095 | A1 | 9/2014 |

OTHER PUBLICATIONS

International Search Report, dated Jan. 17, 2017, from corresponding PCT/FR2016/052769 application.

* cited by examiner

*Primary Examiner* — Robert J Arundale
(74) *Attorney, Agent, or Firm* — Young & Thompson

(57) ABSTRACT

Disclosed is a device for collecting rainwater in a pergola including posts, a frame with beams and slats, arranged transversely, parallel to each other, the slats being articulated about a substantially median axis and being capable of assuming a substantially vertical position and a substantially horizontal position, manual or motorised unit ensuring the coordinated movements of the slats. The device includes a movable unit, rigidly connected to the slats $L_n$, including longitudinal deflectors.

11 Claims, 3 Drawing Sheets

DEVICE FOR COLLECTING RAINWATER IN A PERGOLA WITH ADJUSTABLE SLATS

BACKGROUND OF THE INVENTION

Field of the Invention

This invention relates to a device for collecting rainwater in a pergola with adjustable slats.

DESCRIPTION OF THE RELATED ART

There have been pergolas for numerous years, but these pergolas are stationary.

New pergolas have appeared and were the subject matter of a filing of the French patent application FR 2 676 079 in 1991. Actually, starting from this date, this application has proposed much more sophisticated products that make it possible to modify the shade generated by the pergola based on needs, by also taking into account the position of the sun.

BRIEF SUMMARY OF THE INVENTION

The arrangement of the pergola that is thus described and claimed in this application also proposes controlling the shade to the point where a surface is produced that is closed and impermeable to rain, in a maximum pivoting position.

For this purpose, the pergola proposes a production starting from transverse slats, mounted in a frame that is supported by posts. These slats are section sheets, generally made of aluminum, whose transverse edges make interlocking between slats possible when said slats are totally pivoted, in a position of total concealment. This interlocking with open profiles makes it possible, with a sealing joint, to prevent flow from occurring at right angles to the contact surface of this interlocking.

In the event of rain, the water collected on the surface that consists of thus interlocked slats is to be evacuated. For this purpose, the section sheets lead the water toward the lateral edges of said surface. These flows of water are collected in gutters, arranged longitudinally, which extend under the ends of the slats, constituting the longitudinal edges. These gutters are articulated and follow the slats to be immediately below when the slats are horizontal and to be retracted even lower when the slats are made vertical.

These gutters are arranged in a tilted manner to ensure a flow in the required direction and empty into drainpipes; in this case in an improved embodiment, these drainpipes consist of the hollow support posts of the frame C themselves. The drainpipes are thus concealed, which is particularly aesthetic and does not require any additional conduit.

Within the framework of certain arrangements, slats are provided, but without gutters.

The absence of gutters is rather incompatible in the case of the production of a high-quality pergola because, on the one hand, the volume of water that is collected is large, and this volume of water flows laterally all along the longitudinal edges, causing significant spraying upon contact with the ground, and, on the other hand, once the rain has stopped, the drops continue to fall from these longitudinal edges, often for longer than the rainfall itself lasts.

It is also noted that with the water from the rainfall not being collected, it cannot be directed toward a network of rainwater and therefore it spreads out over the entire surface to the ground, including below the surface that is covered by said slats, which is not acceptable.

BRIEF DESCRIPTION OF THE DRAWINGS

In order to propose an alternative to the articulated gutters, whose cost and technical nature are reserved for high-quality products, the object of this invention is an arrangement that comprises a stationary part and a movable part as will now be described in detail relative to the accompanying drawings, drawings in which the various figures show a preferred, non-limiting embodiment.

DETAILED DESCRIPTION OF THE PREFERRED EMBODIMENTS

Figure 1:
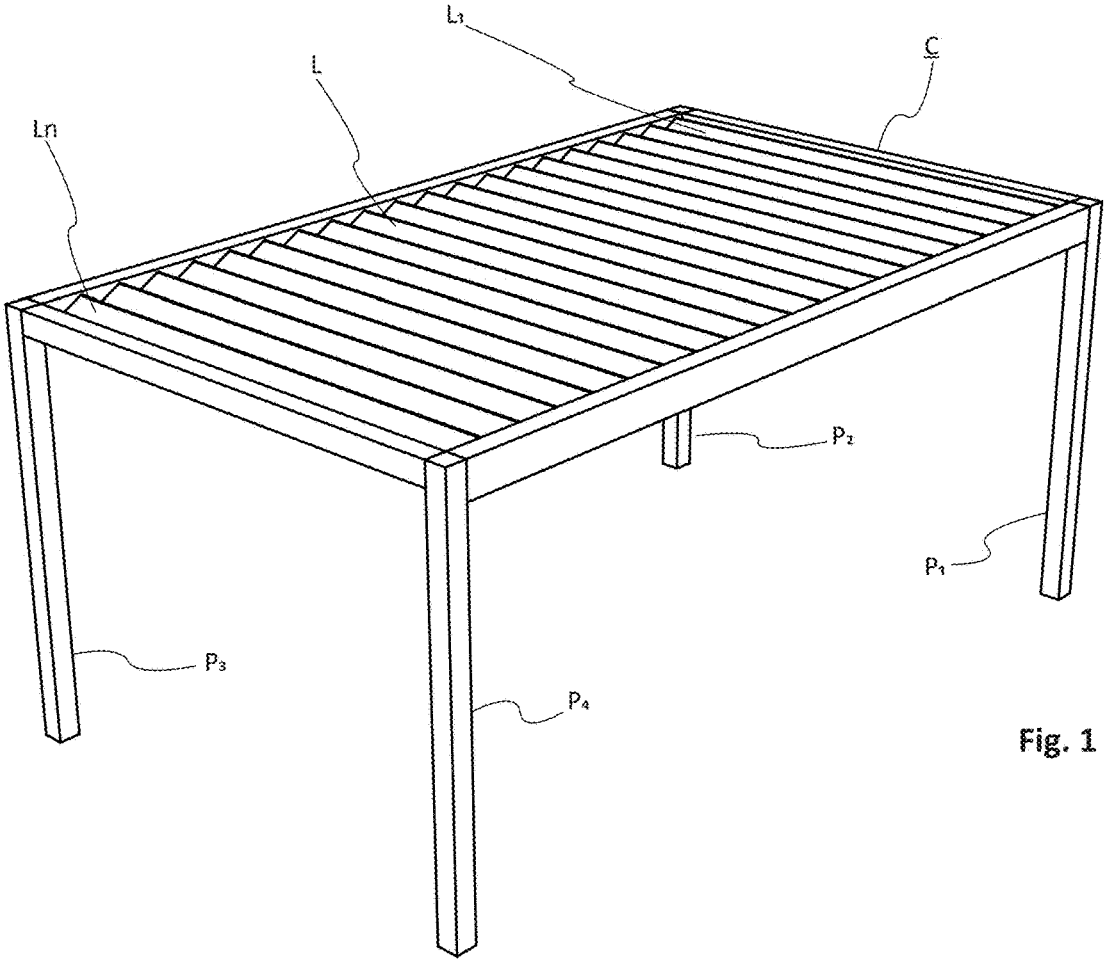
FIG. 1: a diagrammatic perspective view of a pergola according to this invention.

FIG. 1 shows a perspective view of a pergola such as the one that accommodates the arrangement according to this invention.

A pergola comprises posts $P_n$, in this case four posts P1 to P4, a frame C that is supported in the upper part of these posts, and slats $L_n$ that are arranged transversely, parallel to one another. These slats are articulated around an essentially median axis and can assume an essentially vertical position and an essentially horizontal position, in the plane of said axes, with interlocking of the transverse edges to form a continuous flat surface.

Figure 5:
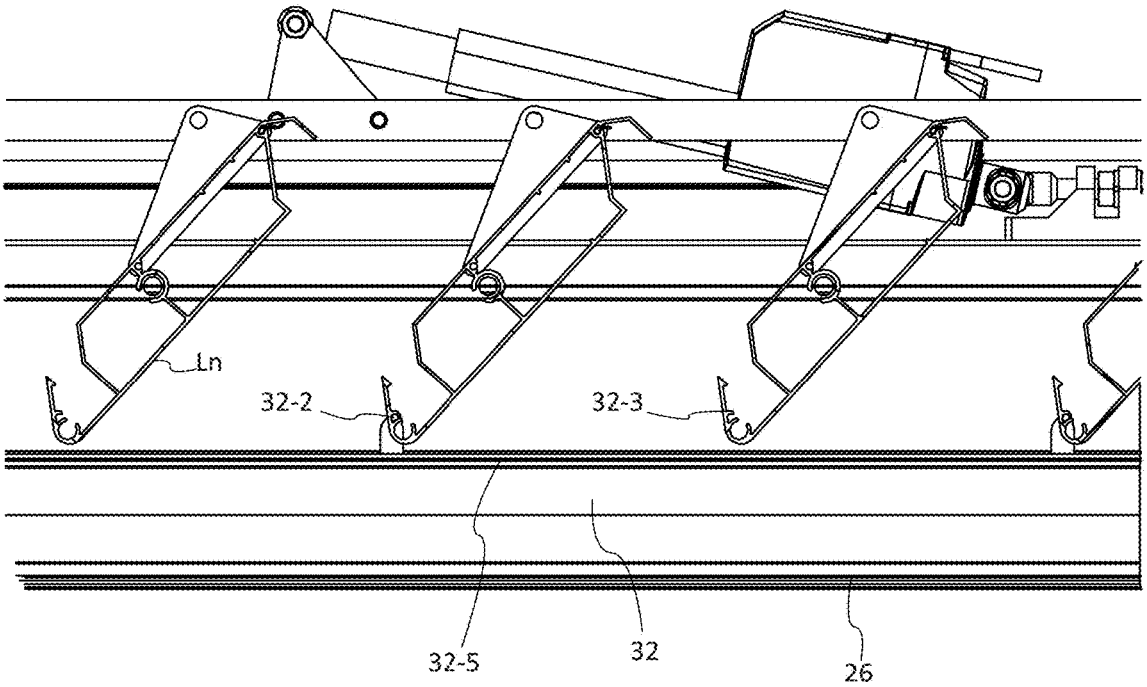
FIG. 5: a view of the movable lower deflector, in non-operating mode, in a position with the slats that are made vertical.
Figure 6:
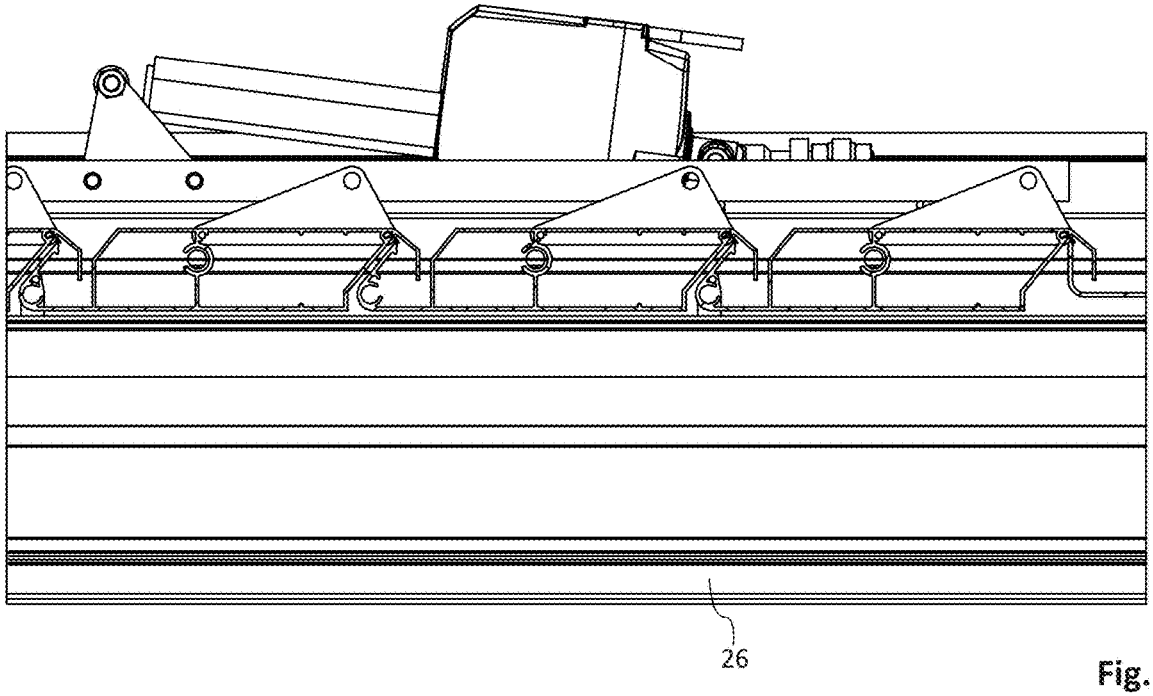
FIG. 6: a view of the movable lower deflector, in operating mode, in a position with the horizontal slats.

Maneuvering means that are motorized or manual with a pole, shown only in FIGS. 5 and 6, ensure movements that are coordinated by means of a connecting rod.

Figure 2:
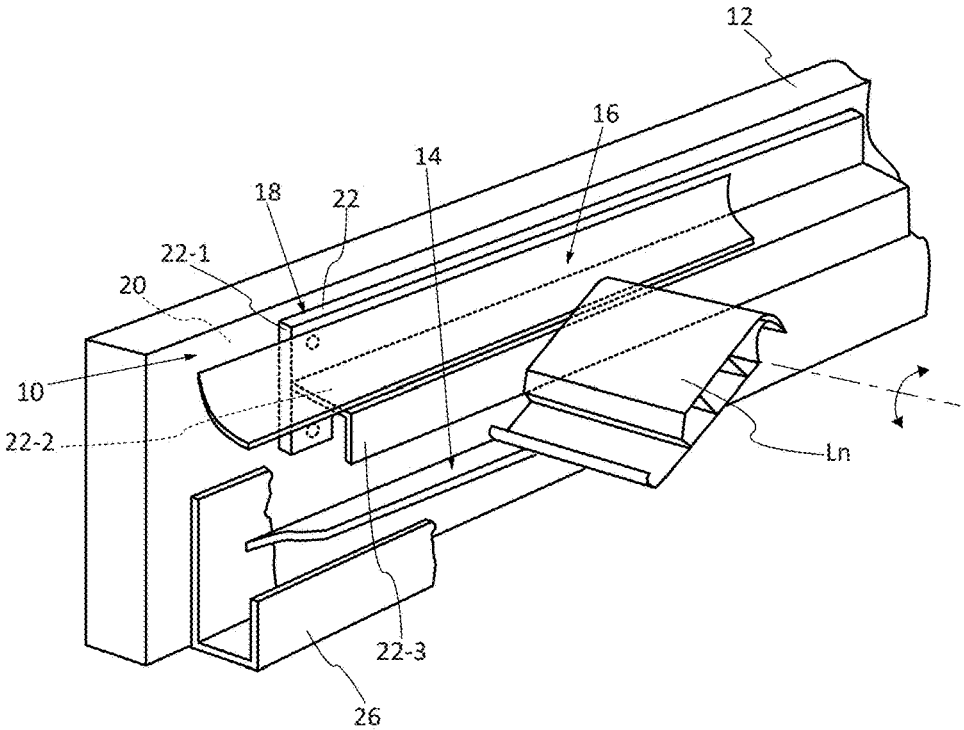
FIG. 2: a detailed diagrammatic perspective view of the arrangement according to this invention.
Figure 3:
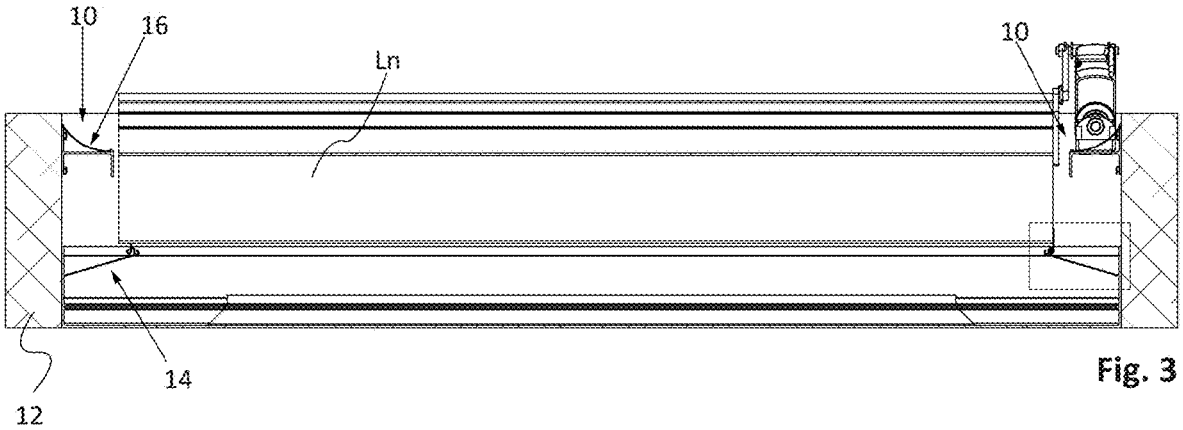
FIG. 3: a transverse cutaway view that shows the deflectors.

In the view of FIG. 2, the perspective view with partial cutaway allows an even more readable rendering of the arrangement according to this invention.

The frame C is found therein.

The device comprises stationary means 10 that are integral with beams 12 that constitute the frame C and movable means 14 that are integral with the slats L.

Figure 4:
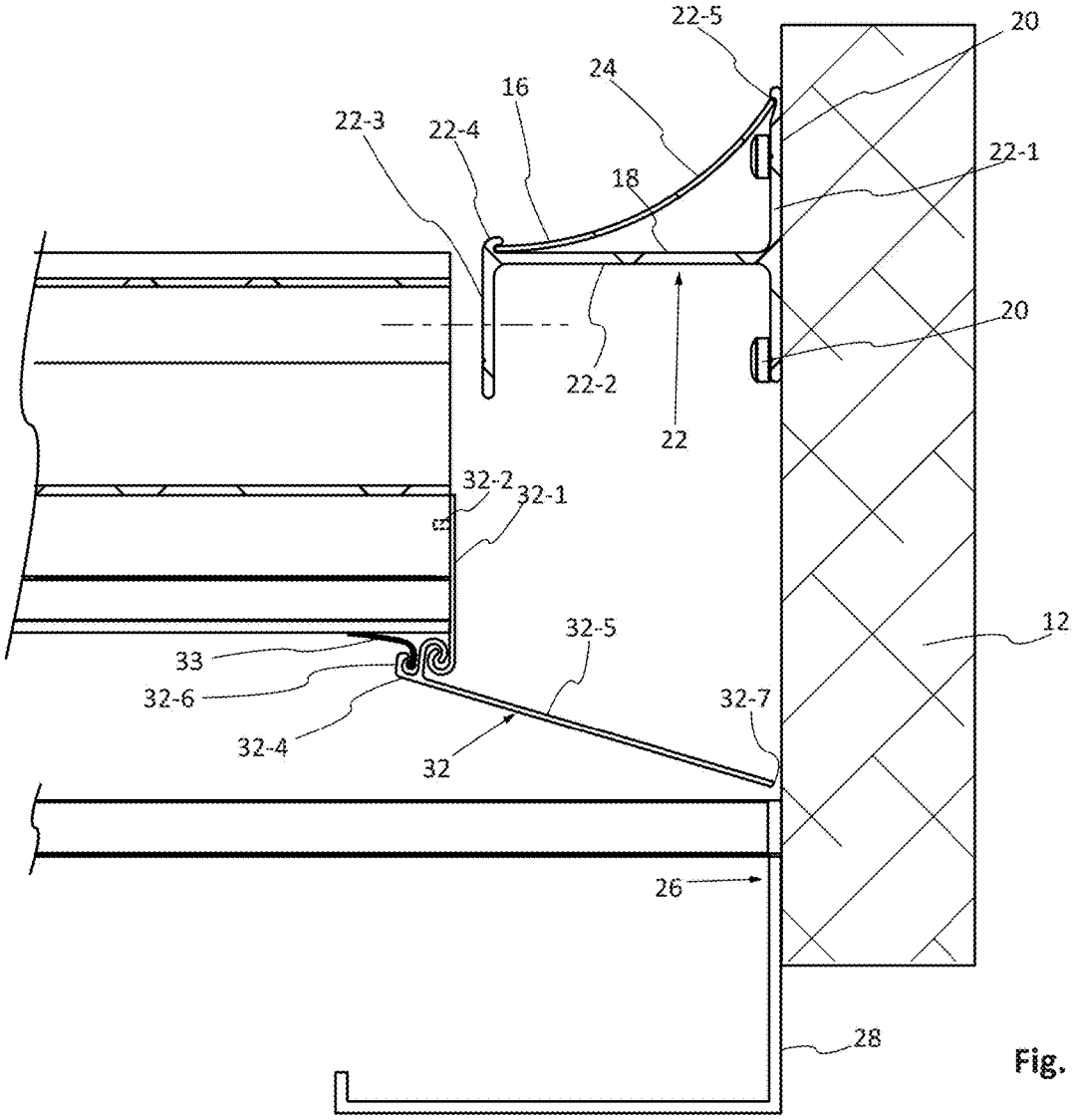
FIG. 4: a detail view of the upper and lower deflectors.

The stationary means 10 themselves comprise upper supports 16, right and left, of the slats. Each support 16 of slats consists of a support 18 that is connected to the frame C and more particularly to the corresponding beam 12, in this case by screws 20 as shown in FIG. 4.

This support 18 is a T-shaped angle bar 22, with the upper branch 22-1 of the T being attached to said beam 12, laterally, therefore in a vertical plane.

The leg 22-2 of this T is then in a horizontal position. This leg 22-2 extends via a branch 22-3, factory-mounted with the angle bar 22. Advantageously, two slots 22-4 and 22-5 are set at right angles to the junction of the leg and the branch and at the upper end of the upper branch of the T.

These slots make it possible to accommodate the edges of a continuous cover 24 that extends all along the beam 12, uniformly supported and held by the slots 22-4 and 22-5.

Advantageously, the cover 24 is flat, but with a width that is greater than the distance that separates the two slots, and the mounting of the longitudinal edges in the slots 22-4 and 22-5 restrains said flap and then imparts thereto a slight curvature, in a preferably concave way.

The length of the leg 22-2 is adapted to be in immediate proximity with the longitudinal edges of the flaps L.

This upper support 16 thus ensures the deflection of the water directly.

In addition, the stationary means 10 comprise stationary gutters 26, right and left, each in the form of a U-shaped section sheet 28 for collecting rainwater, connected, like the angle bar 22, to the corresponding beam 12, in the lower position.

Each stationary gutter 26 is positioned in the lower part of the slats L in the vertical position so as not to disrupt the installation and the maneuvering of said slats.

The movable means 14, integral with the slats $L_n$, comprise longitudinal deflectors 32, right and left, arranged respectively along the longitudinal edges of said slats L, as shown in FIGS. 5 and 6.

More particularly, the deflector 32 comprises a foot 32-1 that is equipped with a journal 32-2, able to work in a pivoting way with the slats, in particular with a housing 32-3 of said slat, visible in FIGS. 5 and 6. The projecting length of the foot 32-1 under the slat avoids impeding the movements of said slat and makes it possible to collect the flow of water as was specified earlier.

The foot 32-1 is equipped in the lower part with a J-shaped profile that accommodates another J-shaped profile that is reversed, set on the inside edge 32-4 of a flat diverter 32-5, which constitutes the deflector 32. A stop 32-6, in the extension of said flat part, is provided for accommodating a possible flying joint 33 and for ensuring a given tilt of the diverter 32-5, once suspended in each slat L, in the immediate proximity of the beam that supports the stationary means 10.

The other free end 32-7 of the diverter 32-5 is arranged at a distance E relative to the beam 12 so as to generate a flow space.

The arrangement is such that this free end 32-7 is located above the stationary gutter 26.

The water circuit is thus subjected, from each side, to circulation in a baffle between the stationary means and the movable means.

Thus, the rainwater that falls directly onto the upper deflector 16 flows over said upper deflector 16 and is conducted toward the deflector 32 of the movable means to flow into the gutter 26.

When the slats are arranged in a horizontal way to form a flat surface that is impermeable to rain, the water that is collected on the slats $L_n$ is conducted by the profile of the slats itself toward the ends of these slats.

The water can flow over the deflector 32 of the movable means 14.

When the slats L are maneuvered to allow light to pass toward a non-horizontal position, the slats that support their movable means 14 are not disrupted.

The movable means are of lightweight manufacture, and the complete arrangement remains at low cost for high-quality pergolas without requiring oversizing.

The stationary gutter 26 is easy to position on the beam that accommodates it.

As for the upper deflector 16, it is also of limited cost and easy to install.

This solution can therefore be an alternative to the arrangement with a movable gutter for collecting rainwater.

The invention claimed is:

1. A system for collecting rainwater comprising:

a pergola including posts, a frame with beams and slats, the beams and slats being arranged transversely, parallel to one another, the slats being articulated around a median axis and configured to assume at least one substantially vertical position and one substantially horizontal position, and a manual or motorized movement system configured to ensure coordinated movements of the slats; and a water flow movement system comprising longitudinal deflectors, the water flow movement system being integral with the slats and movable relative to said slats, wherein each of the deflectors of the water flow movement system is articulated relative to the slats, each of the deflectors including a lug pivotally attached to the slats.

2. The system for collecting rainwater according to claim 1, wherein each lug is equipped with a swivel configured to work in a pivoting way with the slats, the lug being equipped in a lower part thereof with a first J-shaped profile that accommodates a second J-shaped profile that is reversed in relation the first J-shaped profile, set on an inside edge of a flat diverter.

3. The system for collecting rainwater according to claim 2, wherein the flat diverter comprises a stop.

4. The system for collecting rainwater according to claim 2, wherein the flat diverter comprises a flexible member.

5. The system for collecting rainwater according to claim 2, further comprising a gutter that is integral with the beams.

6. The system for collecting rainwater according to claim 5, wherein a free end of the flat diverter is disposed at a flow distance E relative to the beam, above the gutter.

7. The system for collecting rainwater according to claim 3, wherein the flat diverter comprises a flexible member.

8. The system for collecting rainwater according to claim 1, further comprising a gutter that is integral with the beams.

9. The system for collecting rainwater according to claim 3, further comprising a gutter that is integral with the beams.

10. The system for collecting rainwater according to claim 4, further comprising a gutter that is integral with the beams.

11. The system for collecting rainwater according to claim 7, further comprising a gutter that is integral with the beams.

* * * * *